US006106241A

United States Patent [19]

Zimmern

[11] Patent Number: 6,106,241

[45] Date of Patent: Aug. 22, 2000

[54] SINGLE SCREW COMPRESSOR WITH LIQUID LOCK PREVENTING SLIDE

[76] Inventor: Bernard Zimmern, 6 New St., East Norwalk, Conn. 06855

[21] Appl. No.: 09/210,725

[22] Filed: Dec. 15, 1998

Related U.S. Application Data

[63] Continuation-in-part of application No. 08/695,363, Aug. 9, 1996, abandoned.

[30] Foreign Application Priority Data

Aug. 9, 1995 [FR] France ..... 95 09680

[51] Int. Cl.[7] ..... F04B 49/00

[52] U.S. Cl. ..... 417/310; 418/195

[58] Field of Search ..... 417/310; 418/195

[56] References Cited

U.S. PATENT DOCUMENTS 4,373,866 2/1983 Zimmern ..... 417/310
4,704,069 11/1987 Kocher et al. ..... 417/310
5,087,182 2/1992 Zimmern et al. ..... 418/195
5,979,168 11/1999 Beckman ..... 417/310

FOREIGN PATENT DOCUMENTS 2243652 11/1991 United Kingdom .

*Primary Examiner*—Charles G. Freay
*Attorney, Agent, or Firm*—Young & Thompson

[57] ABSTRACT

A single screw compressor includes two gaterotors with associated capacity controller, at the start of the compressor one capacity controller is in a fully unloaded position, and the other capacity controller includes a slide, a thrust mechanism for moving the slide, and an elastic mechanism for holding the slide in a position of part load when the compressor is stopped, the elastic mechanism being deformed during start to let the slide reach a full load position as soon as the discharge pressure of the compressor reaches a set value.

12 Claims, 2 Drawing Sheets

SINGLE SCREW COMPRESSOR WITH LIQUID LOCK PREVENTING SLIDE

This application is a continuation-in-part of copending application Ser. No. 08/695,363 entitled "Screw Compressor with Liquid Lock Preventing Slide" filed on Aug. 9, 1996, now abandonned.

TECHNICAL FIELD

This invention relates to a positive displacement rotary compressor of the screw and gaterotor type.

BACKGROUND OF THE INVENTION

It is known to build single screw compressors using slides in the casing to change the capacity of the compressor.

Such arrangements are shown on many patents such as U.S. Pat. Nos. 4,261,691, 4,579,513 or 5,087,182.

One serious problem encountered by these compressors happens when the compressor is used in a refrigeration or air-conditioning application and is started partly or totally filled with liquid refrigerant. Such phenomenon is well known in the industry and can be created by many circumstances: a leaking injection valve, a compressor being cooler than the evaporator, etc.

If the compressor is started with enough liquid in it, the general result is a degradation of the performances of the compressor, degradation which is the consequence of considerable pressure generated into the grooves of the screw which have to compress a non-compressible fluid, the liquid refrigerant, instead of the compressible refrigerant gas; such compression of liquid is also known as "liquid lock" as sometimes the motor cannot turn the compressor and stalls.

A solution generally used in screw compressors is to start the compressor with the slides in a position where the compressor capacity is minimum, generally around 15 to 20% of the full load.

In such case indeed, as soon as the groove stops to be in communication with suction, it starts to register with the discharge port; so there is no compression happening in a groove and it can pump liquid without encountering a liquid lock.

This solution has nevertheless many drawbacks; first of all, this obliges generally to provide a control for the slide with at least three positions: starting position with 15% capacity, a part load position with around 40 or 50% capacity and a full load position (a compressor with only a 15% capacity position and full load would have too much change between these two levels); as the slide is most often controlled by a piston, this means that the control must provide three positions which is much more complex than a piston having simply two positions achieved by applying or not a pressure to the piston. Another solution is to provide the piston with an infinite number of positions by a continuous control which is even more complex.

A second drawback is that, at 15% capacity, the compressor builds up pressure in the condenser very slowly; as the compressor pressure is generally used to move the liquid injected into the compressor to cool it, whether oil or liquid refrigerant, there is a risk of lack of liquid injection resulting in a compressor seizure.

In oil injection free compressors (OIF compressors) where there is no oil injected in the compressor but liquid refrigerant from the condenser, it is practically mandatory to start the compressor at around 50% capacity so as to build up pressure fast and start liquid injection within approximately 10 seconds.

In the new generations of single screw compressors where the two slides operate independently, one being fully unloaded at start-up, this implies that the other slide has to start in the full load position; if there is liquid, as compression occurs on the full length of the groove, liquid lock occurs with all its consequences.

SUMMARY OF THE INVENTION

A single screw compressor having two gaterotors and capacity control means associated with each gaterotor, wherein, at the start of the compressor, one capacity control means is in a fully unloaded position to ensure no compression and the other capacity control means includes a slide, a thrust means for moving the slide, and an elastic means for holding the slide in a position of part load when the compressor is stopped, and wherein the elastic means is deforming during start to let the slide reach a full load position as soon as the discharge pressure of the compressor reaches a set value.

This value can be set between 1.2 and 2 times the suction pressure but is best set at around 1.5 times suction pressure.

The invention works as follows:

At start-up, the slide is at part load due to the elastic means; even if liquid is present, no liquid lock occurs.

This is remarkable as in a capacity control position around 50% there is still compression happening in a close groove; compression ratio of 1 to 3 are customary, that is the volume of the groove before it registers with discharge is around one third of the volume when the groove stops registering with suction; so if the groove is filled with liquid, liquid lock should occur. It has nevertheless been found through tests with compressors having two slides (one fully unloaded at start-up that we'll designate as slide A, the other one having only two positions: full load and roughly half load called slide B), if slide B is disposed in such a way that the corresponding half compressor compressing is in the lower part of the compressor, it is possible to start the compressor half full without liquid lock. Liquid lock occurs when starting with slide B at full load. If slide B is at part load, the pressure builds up too slowly to start liquid injection before seizure of the compressor.

If slide B is in the upper part of the compressor, the compressor can be started even completely full with liquid, without liquid lock.

The absence of liquid lock is proven by looking to the pressure in the groove using a pressure probe and/or the intensities of the electrical current passing through the motor driving the compressor.

In the two cases mentioned above, pressures and intensity are the same as in a normal start whereas when there is liquid lock, the pressure is many times higher and the intensity stays extremely high for an extended period of time, showing that the motor is not accelerating but stalling.

In those two cases (with slide B in the lower or the higher position), to empty the compressor from liquid takes a fraction of a second.

Immediately afterwards, the compressor starts building up pressure in the condenser; the pressure acting on the end of the slide, compresses the elastic means and brings the slide to the full load position.

With the other side fully inoperative, the compressor is then at 50% load and can build quickly pressure in the condenser for liquid injection.

Tests on a single screw delivering around 200 cfm at 3600 rpm operating on R22 have shown that a compressor half full or full with liquid is emptied between 0.15 to 0.3 seconds; and that with elastic means such as springs set to be compressed when discharge pressure reaches around 1.5 time suction pressure, the slide is back to full load in 2 to 3 seconds.

So there is practically no delay incurred to reach injection pressure.

At the same time, the thrust means controlling the position of the slide, in this case a piston, needs only two positions and this can be achieved by putting or not discharge pressure behind the piston.

BRIEF DESCRIPTION OF THE DRAWINGS

A brief description of the drawings follows.

DESCRIPTION OF THE PREFERRED EMBODIMENTS

Figure 1:
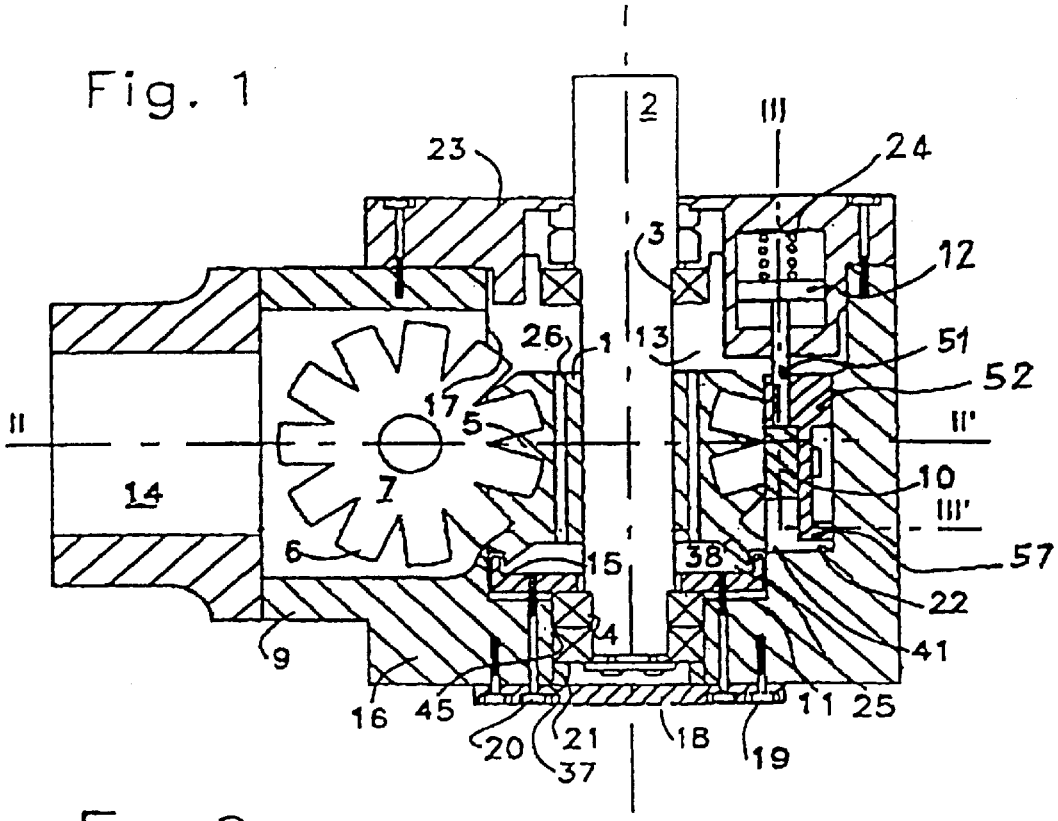
FIG. 1 is a cross section on line I—I' of FIG. 2.

A more complete understanding of the invention may be had from the following description of a preferred embodiment of a compressor incorporating the invention and illustrated in the drawing where:

In FIG. 1, a screw 1 mounted on a shaft 2 rotatably supported by bearings 3 and 4 has threads 5 engaging the teeth 6 of two symmetrical gate-rotors 7 and 8. The screw and the gate-rotors are rotatable in a casing 9. When used for operation in a refrigeration system, the casing 9 is usually equipped with one or more slides 10 preferably constructed in accordance with the teaching of U.S. Pat. No. 4,571,166. The slides 10 are axially movable by thrust means such as pistons 12, in turn, actuated by fluid power means such as oil pressure or discharge pressure gas.

The casing 9 has a suction or low pressure port 13 in communication with suction piping 14. Discharge ports 41 are located near the gate-rotor close to the high pressure end 38 of the screw 1. The screw 1 is sealed with respect to the casing 9 on the high pressure end 38 by a high pressure end seal 15, the details of which are shown in U.S. Pat. No. 4,475,877.

According to U.S. Pat. No. 5,087,182, the casing 9 includes an annular wall portion or hoop 16 transverse to a main bore 17 on the interior of the casing and in which the screw 1 is rotatably positioned. The wall 16 has an exterior end face 37 against which an end plate 18 is held by bolts 19. Additional bolts 20 extend from the end plate 18 to end seal 15 to draw the end seal 15 against the bearing 4 and through a shim 21 against the end plate 18; this leaves a clearance space 11.

It can be seen also that a gutter 22, in which the slide 10 and its fixed support 52 are received, ends at an axial location spaced from the clearance space 11.

The volume 25 between the end of the screw 1 and the seal 15 is connected to suction pressure by one or more holes 26 in the screw in accordance with conventional practice.

Figure 2:
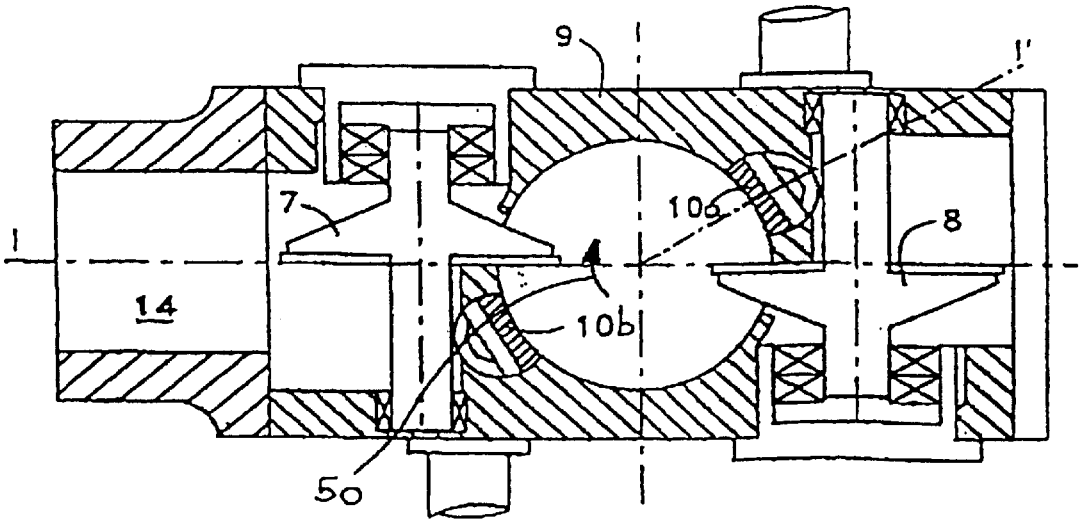
FIG. 2 is a cross section on line II—II' of FIG. 1.

This invention is described thereafter with two gaterotors and two slides as shown in FIG. 2 but is applicable to a single screw compressor where only one gaterotor is cooperating with a slide and the other gaterotor is cooperating with another type of capacity control means such as poppet valves shown for instance in U.S. Pat. No. 3,804,564 or a turnvalve as shown on UK Patent No. 2 051 244 provided such capacity control means are fully unloaded at the start of the compressor.

In most recent single screw compressors, the two slides 10*a* and 10*b* are different, one having two positions full load and fully unloaded, the other one full load and roughly half load; the first shall be designated as slide A and the second as slide B.

If slide A is in the lower part of the compressor as shown on FIG. 2, as the screw turns according to the direction of arrow 50, this is the lower part of the compressor which is compressing. in such case, the compressor can be started half full of liquid without liquid lock but liquid lock can still occur if it is full.

If slide A is in the bottom and B on the top, then the compressor can be started full with liquid without liquid lock.

The reason why the compressor can start with this invention whereas it can't if the slide is at full load is not clear; whether at full load or part load, in both cases the grooves should be filled with liquid and compression of an incompressible liquid should happen. It is likely that at the very beginning during the first screw turn the grooves are full but that after the compressor starts running a little there is enough motion in the liquid and/or drop of pressure to generate flash gas and that thereafter the volume of liquid sucked by any groove is smaller than the minimum volume of the groove reached before discharge; and it is likely that it is a matter of degree, that is that this phenomena is not sufficient to prevent liquid lock if the slide is at full load but is sufficient if the groove compresses only on half its length and this more so if the groove is not in the lower but is the upper side (slide B in the upper side).

Figure 3:
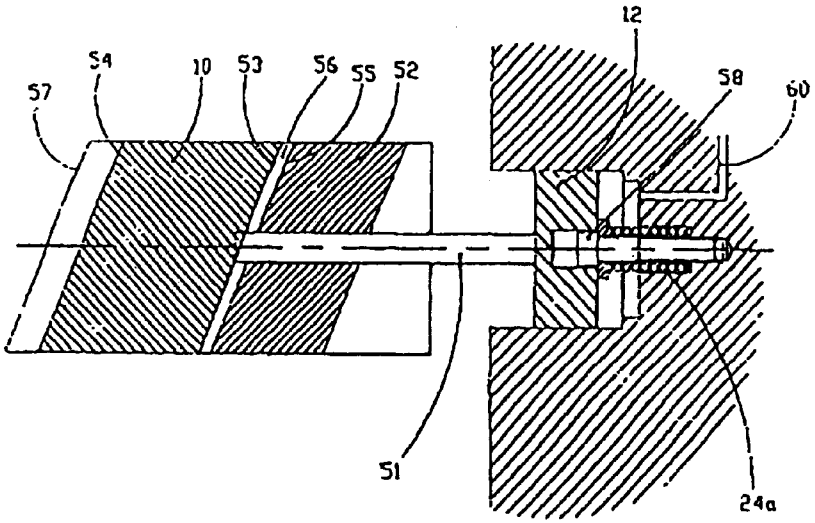
FIG. 3 shows a cross section along III—III' of FIG. 1.

FIG. 3 shows a view of slide B according to FIG. 2.

The slide is pushed by thrust means such as a piston 12 and a rod 51. Pressure, oil pressure for instance, produced by a pump or discharge gas pressure, is put behind the piston by a tube 60 to move the slide to the part load position; when pressure is removed from tube 60, the pressure at the end 54 of the slide pushes the piston back and brings line 53 in contact with line 56, insuring that the side is at full load.

The fix part of the slide built in that example as in French patent 2,562,167 (but other constructions are possible without changing the invention) is shown as 52 and the movable part as 10.

On FIG. 3 the movable part 10 is shown partly opened by the spring means 24*a*, in the position it occupies at start-up.

The movable part 10 extends between line 53 and 54; between the edge 53 of the movable part and the edge 55 of the fixed part there is a gap 56 by which the liquid—or gas—can escape and return to suction; so in a well known manner, the compression starts only when the grooves are fully in front of the area beyond the edge 53.

It should be noted that the slide 10 is not fully opened at start up; when part load is necessary discharge pressure—or oil pressure—is applied behind the piston 12, which pushes the slide until the edge 54 reaches line 57 (which is also preferably the high pressure end of the fixed part 52; as seen in FIG. 1).

Figure 4:
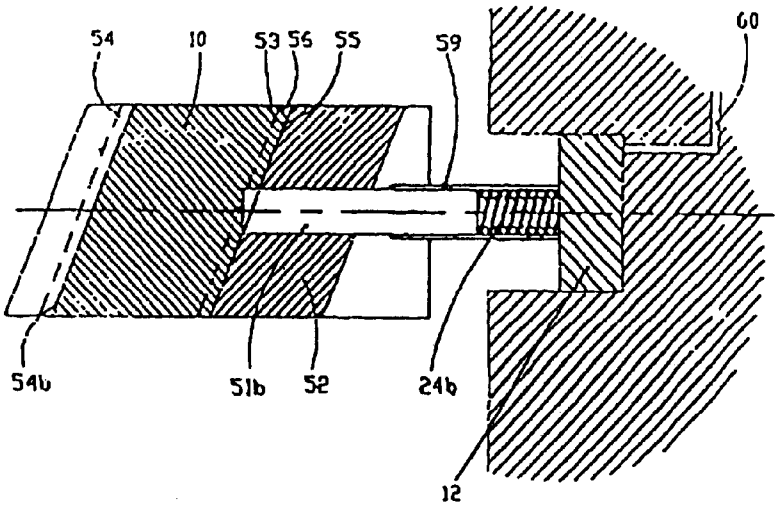
FIG. 4 shows a different arrangement of FIG. 3.

A bolt 58 limits the displacement provided by the spring 24*a* so as to control the opening width 56 to a value sufficient to let the liquid escape at start-up without creating a major over pressure in the groove but small enough to have the maximum capacity to the compressor and build up pressure in the condenser as fast as possible. FIG. 4 shows a different arrangement with the rod 51*b* pushing the slide 10 and set in a tube 59 which has a spring 24*b*.

In this FIG. 4, the slide 10 is shown a few seconds after start-up; the pressure having built-up on the discharge end of the compressor pushes against the end of the movable slide 10 and has moved the edge from the position 54 occupied initially when the spring 24*b* was extended, to the position 54*b*; in this position, the movable part 10 is pressed against the fix part 52 and the slide is at the full load position.

To that effect, whether in the case of FIG. 3, FIG. 4 or any equivalent solution, the spring is so calculated as to be fully compressed when the discharge pressure reaches a value set between 1.2 to 2 times suction pressure and generally around 1.5 times.

It should be noted that as soon as that pressure is reached, whether in the case of FIG. 3 or FIG. 4, the slide occupies the position it would have occupied if there were no elastic means and the compressor delivers the same gas flow as if these means did not exist.

It should also be noted that the invention was shown with a piston pushing the slide but the invention can be easily transposed to the case of the pistons located at the opposite side of the slides and which pull; or to those of elastic means which would operate by traction, not compression and would, for instance, be attached to the high pressure side of the movable part 10.

What is claimed is:

1. A single screw compressor comprising:

a first gaterotor with an associated first capacity control means, said first capacity control means being designed and adapted to be in a fully unloaded position at the start of the compressor so as to ensure no compression in said first gaterotor when the compressor is being started; and a second gaterotor with an associated second capacity control means, said second capacity control means comprising a slide, a thrust means for moving said slide, and an elastic means operatively connected to said slide, said elastic means being designed and adapted for holding said slide in a position of part load when the compressor is stopped, and being deformable during the compressor start to permit said slide to reach a full load position when a discharge pressure of the compressor reaches a set value.

2. The compressor of claim 1, wherein said set value is 1.2 to 2 times a suction pressure of the compressor.

3. The compressor of claim 2, wherein said set value is approximately 1.5 times the suction pressure of the compressor.

4. The compressor of claim 3, wherein said elastic means holds said slide in a position of approximately half load when the compressor is stopped.

5. A single screw compressor comprising:

two gaterotors and a capacity control means associated with each of said gaterotors, wherein, at the start of the compressor, one of said capacity control means is in a fully unloaded position ensuring no compression takes place in the associated gaterotor when the compressor is being started, and the other of said capacity control means comprises a slide, a thrust means for moving said slide, and an elastic means for: i) holding said slide in a position of part load when the compressor is stopped, and ii) deforming during start of the compressor to let said slide reach a full load position as soon as a discharge pressure of the compressor reaches a set value.

6. The compressor of claim 5, wherein said set value is 1.2 to 2 times a suction pressure of the compressor.

7. The compressor of claim 6, wherein said set value is approximately 1.5 times the suction pressure of the compressor.

8. The compressor of claim 5, wherein said elastic means holds said slide in a position of approximately half load when the compressor is stopped.

9. A single screw compressor comprising:

two gaterotors and two slides, each of said slides being associated with a different one of said gaterotors;

a first means constructed and arranged to hold one of said slides in a fully-unloaded position ensuring no compression in a respective one of said gaterotors when the compressor is being started; and a spring constructed and arranged to hold the other of said slides in about a part-load position ensuring compression in the other one of said gaterotors when the compressor is being started, said spring being constructed and arranged to allow said other slide to reach a fully loaded position when a discharge pressure of the compressor reaches a set value.

10. The compressor of claim 9, wherein said set value is 1.2 to 2 times a suction pressure of the compressor.

11. The compressor of claim 10, wherein said set value is approximately 1.5 times the suction pressure of the compressor.

12. The compressor of claim 9, wherein said second spring holds said other slide in a position of approximately half load when the compressor is stopped.

* * * * *